US006315293B1

(12) United States Patent
Bush

(10) Patent No.: US 6,315,293 B1
(45) Date of Patent: Nov. 13, 2001

(54) BASEBALL BOARD GAMES WITH RAISED STADIUM INDICIA

(75) Inventor: Chris Bush, Newnan, GA (US)

(73) Assignee: Universal Baseball Corporation, Newnan, GA (US)

( * ) Notice: Subject to any disclaimer, the term of this patent is extended or adjusted under 35 U.S.C. 154(b) by 0 days.

(21) Appl. No.: 09/511,138

(22) Filed: Feb. 23, 2000

Related U.S. Application Data

(60) Provisional application No. 60/121,336, filed on Feb. 23, 1999.

(51) Int. Cl.[7] ..... A63F 3/00

(52) U.S. Cl. ..... 273/244.1; 273/259; 273/277; 273/285; 273/287

(58) Field of Search ..... 273/244.1, 287, 273/277, 247, 259, 285, 241, 282.1

(56) References Cited

U.S. PATENT DOCUMENTS 693,478 * 2/1902 Wooside .
1,168,729 * 1/1916 Krebs .
1,518,030 * 12/1924 Waller .
1,561,421 * 11/1925 Erickson .
2,548,606 * 4/1951 Huffaker .
2,724,595 * 11/1955 Amann .
2,933,316 * 4/1960 Mancini .
2,946,134 * 7/1960 Neilson .
3,130,973 * 4/1964 Zaploski .
3,537,552 * 11/1970 Noble .
3,851,885 * 12/1974 Pepkowski .
4,209,085 * 6/1980 Kozan .
4,277,067 * 7/1981 Gettleman .
4,811,954 * 3/1989 Hemmann .
4,907,804 * 3/1990 Arad .
5,145,185 * 9/1992 Yu .

* cited by examiner

*Primary Examiner*—Benjamin H. Layno
*Assistant Examiner*—V K Mendiratta
(74) *Attorney, Agent, or Firm*—Thomas, Kayden Horstemeyer & Risley, LLP

(57) ABSTRACT

A preferred embodiment of the board game incorporates a carrying case which includes a base and a lid. The base preferably includes a wall extending upwardly from a periphery thereof, with the wall having first and second ends which are spaced from each other to form a first gap therebetween, with the first gap being sized and shaped for passing a die therethrough. A playing surface is arranged on the base with at least a portion of the playing surface preferably being formed of a flocked plastic material which provides deadening of sound produced by the die impacting the playing surface. Game pieces representative of baseball players and/or their equipment, i.e. bats, batting helmets, etc., also arc provided which arc adapted to be moved about the playing surface in accordance with rules of game play.

11 Claims, 4 Drawing Sheets

BASEBALL BOARD GAMES WITH RAISED STADIUM INDICIA

CROSS-REFERENCE TO RELATED APPLICATIONS

This application is based on and claims priority to U.S. Provisional Application Ser. No. 60/121,336, filed on Feb. 23, 1999, and which is incorporated by reference herein in its entirety.

BACKGROUND OF THE INVENTION

1. Field of the Invention

The present invention relates to board games and, in particular, to board games for simulating the play of baseball thereon.

2. Description of the Related Art

Prior art baseball board games are known that allow same players to simulate the play of baseball. These games typically are played on game boards which commonly incorporate indicia, such as stickers, that are affixed to the upper surface of the game board to form colorful game playing surfaces representative of a baseball field. The game boards generally are stored in a folded configuration with flat segments of the boards overlying each other. The folded game boards are then opened and placed upon a flat surface, such as a tabletop, prior to starting game play. Game play then takes place on the upper surface of the game board about which game pieces are utilized in order to simulate the play of the game.

For those prior art baseball board games utilizing dice, the dice typically are rolled on the upper surface of the game board. Once rolled, it is not uncommon for the dice to roll off of the game board and off of the tabletop or other surface upon which the game board is oriented. This has the effect of interrupting game play and also allows the dice to be lost or, otherwise, misplaced.

Therefore, there is a need to provide improved baseball board games which address these and other shortcomings of the prior art.

SUMMARY OF THE INVENTION

Certain objects, advantages and novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

Briefly stated, the present invention generally relates to board games for simulating the play of baseball thereon. A preferred embodiment of the board game incorporates at least one die, a carrying case, a playing surface, and game pieces. Preferably, the carrying case includes a base and a movable lid hingedly attached thereto, with the lid being movable between a closed position and an open position. In the closed position, the lid engages the base to define a cavity therebetween, with the base including a wall which has first and second ends spaced from each other and forming a gap therebetween. Preferably, the gap is sized and shaped for passing the at least one die therethrough. Additionally, the playing surface is arranged on the base and is bounded at least partially thereabout by the wall. Preferably, the playing surface also includes indicia of baseball bases formed thereon.

In accordance with another aspect of the present invention, a preferred embodiment of the board game includes at least one die and a playing surface configured to roll the die thereon. Preferably, at least a portion of the playing surface is formed of a flocked plastic material so that the flocked plastic material provides deadening of sound produced by the die impacting the playing surface. A plurality of game pieces also may be provided.

In accordance with another aspect of the present invention, a preferred method aspect comprises the steps of: (1) providing a playing surface; (2) providing at least one die; (3) providing rules for determining game play; (4) rolling the at least one die onto the playing surface such that the die remains on the playing surface after the die has ceased rolling, and; (5) referring to the rules to determine game play based on a first number displayed upon the die.

The numerous features and advantages of the present invention will be more readily apparent from the following detailed description read in conjunction with the accompanying drawings.

BRIEF DESCRIPTION OF THE SEVERAL VIEWS OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENT

Figure 1:
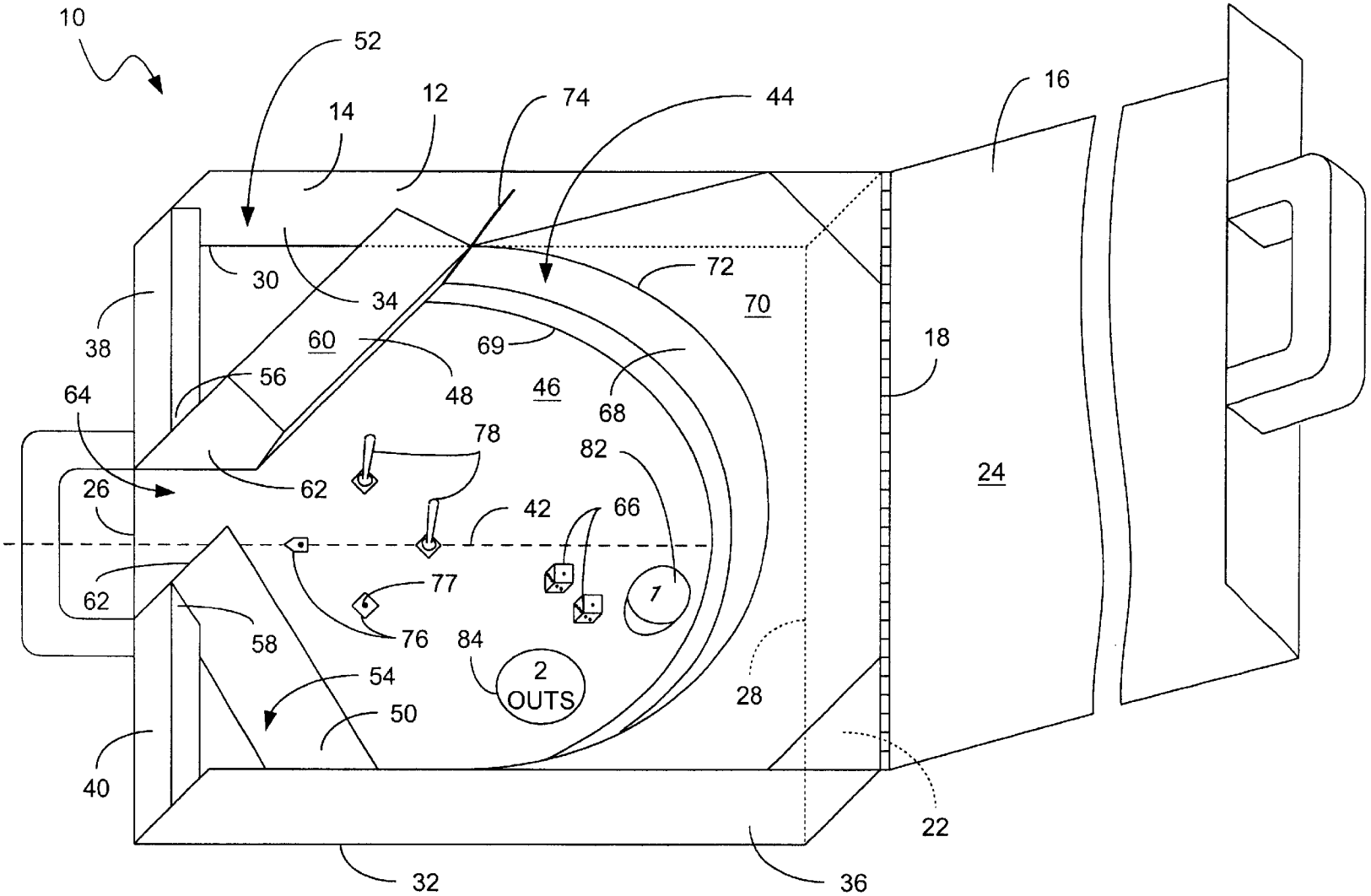
FIG. 1 is a perspective view of a preferred embodiment of the present invention with the lid in an open position.

Reference will now be made in detail to the description of the invention as illustrated in the drawings, wherein like reference numbers indicate like parts throughout the several views. As shown in FIG. 1, a preferred embodiment of the baseball board game 10 of the present invention incorporates a carrying case 12 which includes a base 14 and a lid 16. Preferably the lid 16 is hingedly attached to base 14 by one or more hinges 18 so that the lid is pivotable between a closed position and an open position (shown in FIG. 1). Preferably, the lid 16 is prevented from rotating about its hinges 18 past a predetermined position so that the inside surface 24 of the lid 16 is appropriately positioned for serving as a mounting surface for various indicia such as logos, gaming instructions, scoreboards, etc.

As shown in the embodiment of FIG. 1, base 14 incorporates a generally rectangular shape and includes opposing front and rear edges 26 and 28, respectively, and opposing side edges 30 and 32, respectively interconnecting the front and rear edges. A series of side walls extend upwardly from the edges of the base 14, e.g., side walls 34 and 36 extending from side edges 30 and 32, respectively, and rear wall 22 extending from rear edge 28. Additionally, front wall segments 38 and 40 extend along front edge 26 with each of the front wall segments extending inwardly from a side wall toward a center line 42 of the base 14. Thus, the rear wall 22, side walls 34 and 36, and front wall segments 38 and 40 cooperate to define a cavity 44.

Within the cavity 44, one or more barriers can be provided for defining the periphery of a game playing surface 46, which preferably incorporates indicia of a baseball playing field. Preferably, containing barriers 48 and 50 are provided for creating a pair of dugouts or game piece compartments 52 and 54, respectively, with containing barriers 48 extending from the distal end 56 of front wall segment 38 and intersecting side wall 34, and containing barrier 50 extending from the distal end 58 of front wall segment 48 and extending to side wall 36 to form the respective game piece compartments. So configured, the game piece compartments 52 and 54 provide storage areas for game pieces (described in greater detail hereinafter). Each containing barrier 48 and 50 preferably includes an upper surface 60 which is inclined downwardly and inwardly toward the playing surface 46.

In some embodiments, such as the embodiment depicted in FIG. 1, barrier end walls 62 may be provided which are spaced from each other to form a dice chute or gap 64 therebetween. The gap is sized to allow dice, which are rolled onto the playing surface 46 during game play, to be rolled therethrough and onto the playing surface 46. Dice, such as dice 66, typically are rolled by a player through gap 64 and onto the playing surface 46 so that the dice impact a fence 68, which preferably is formed as an arcuate wall segment that extends between the side walls and forms the rear boundary of the playing surface 46. As described in detail hereinafter, and in accordance with preferred rules of game play, dice should be rolled through the dice chute and against the fence, with at least one of the dice preferably ending its roll clear of warning track 69.

Additionally, a rear containing wall 70 can be included which is inclined inwardly and downwardly from rear wall 22 and side walls 34 and 36 and which merges with an upper edge 72 of the fence 68. So configured, dice which arc misthrown onto the playing surface 40 preferably are deflected by the rear containing wall 70, and/or the upper surfaces 60 of the containing barriers 48 and 50, so that the dice are redirected toward the playing surface 46.

Preferably the playing surface 46 incorporates a flocked plastic material which provides sound dampening to the board game, thereby reducing the noise level of dice 66 impacting the playing surface 46 as the dice are rolled during game play. The flocked material also provides the additional benefit of simulating the grass of an actual baseball playing field. Additionally, the dice may incorporate the flocked material, thereby further reducing the noise level of dice impacting the playing surface. Other stadium indicia also can be incorporated into the board game 10 such as by affixing stickers, which are representative of various stadium features, to corresponding portions of the game board 10. Additionally, various three dimensional structures, such as miniature molded features arranged at appropriate locations about the board game, i.e., foul pole 74, for example, can be provided. However, preferred embodiments of the board game which incorporate three dimensional structures representative of stadium features preferably do not incorporate such features on upper surfaces 60 or rear containing wall 70 so that redirection of mis-thrown dice 66 toward the playing surface 46 is not inhibited. It should be noted that, in accordance with preferred rules of game play, dice 66 which are mis-thrown and which do not remain on the playing surface after rolling of the dice has ceased constitute a "foul," whereby the dice are not considered "in play." Thus, maintaining the dice upon the playing surface may be considered a critical aspect of game play in some embodiments.

Figure 2:
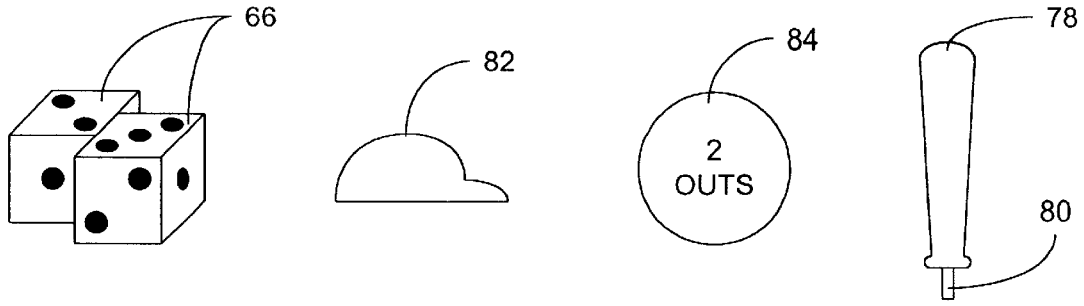
FIG. 2 is a schematic view of game pieces which are utilized in a preferred embodiment of the present invention.

As shown in FIG. 1, playing surface 46 incorporates traditional baseball field indicia such as bases 76. Each base 76 preferably incorporates a hole 77 which is adapted to receive a playing piece 78. As depicted in FIG. 2, playing pieces 78 preferably are configured as miniature baseball bats which each incorporate a peg 80 extending from a lower portion thereof. So configured, each playing piece 78 is removably mountable at each base 76 by inserting its peg 80 into the hole of the base. A set of miniature baseball hats 82 and markers 84 also are provided and can be utilized for simulating game play, such as in accordance with preferred rules of game play that are provided hereinafter in Appendices A and B.

Figure 3:
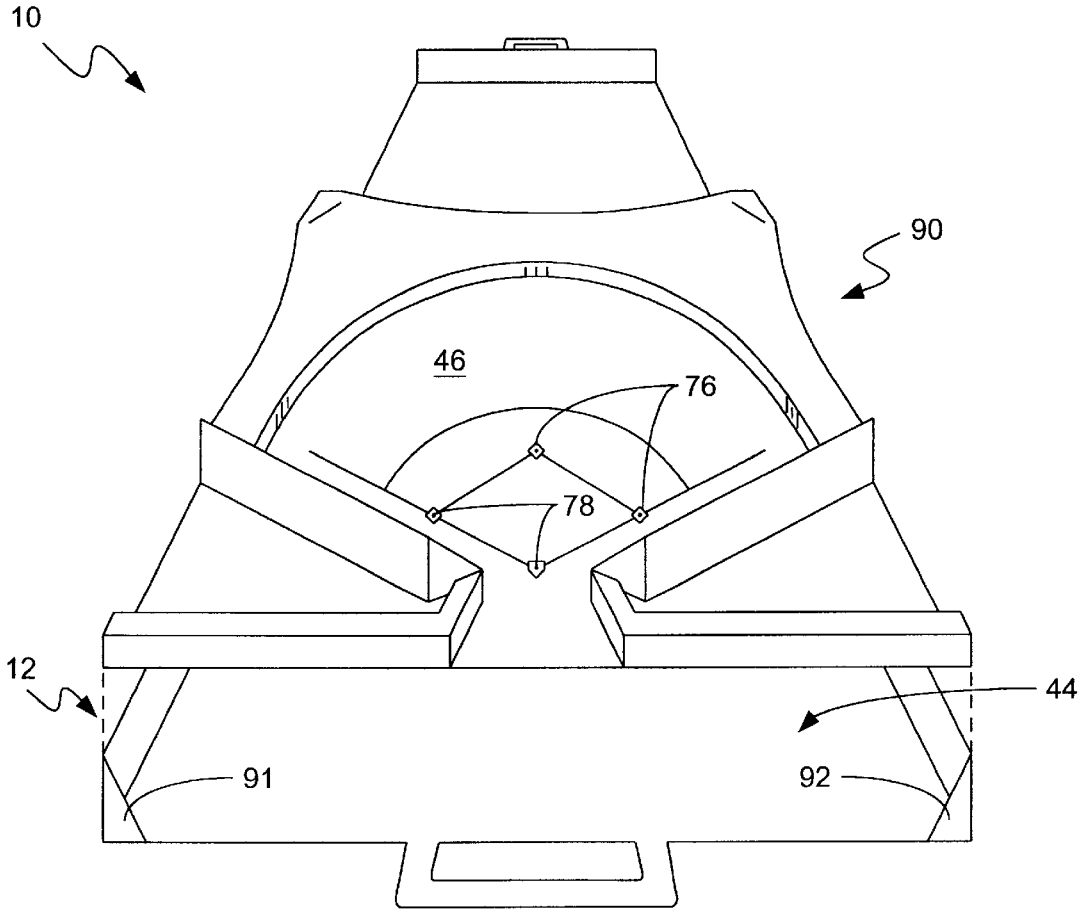
FIG. 3 is a partially exploded perspective view of an alternative embodiment of the present invention.

As shown in FIG. 3, an alternative embodiment of game 10 incorporates a case 12 which cooperates with a gaming insert 90. The insert 90 is placed within cavity 44 of the case 12 and is properly oriented by engaging between the side walls, rear wall and front wall segments 91,92 of the case. As shown in the embodiment of FIG. 3, playing surface 46 is incorporated on the upper surface of the insert and includes game field indicia such as infield markings and bases 76. In other embodiments, however, the playing surface can be formed as a portion of case 12 such that the insert surrounds the playing surface once it is inserted within the base 12. So configured, a manufacturing cost savings may be realized by reducing the amount of material required to form the insert. Alternatively, the containing walls and other protruding features can be formed as a unitary portion of the case, such as by molding the case 12 with the aforementioned features. So constructed, a playing surface insert (not shown) then can be provided that cooperates with the base, such as by engaging between the containing walls.

Figure 4:
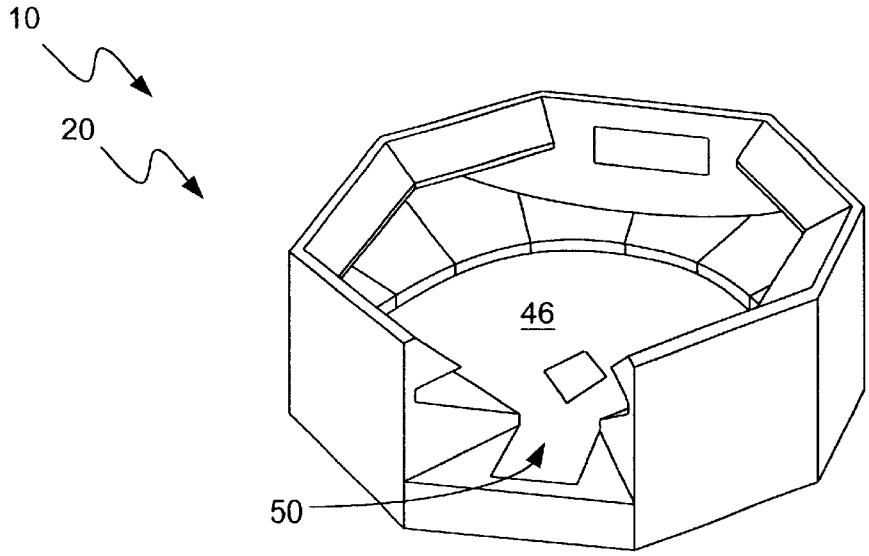
FIG. 4 is a perspective view of an alternative embodiment of the present invention.
Figure 5:
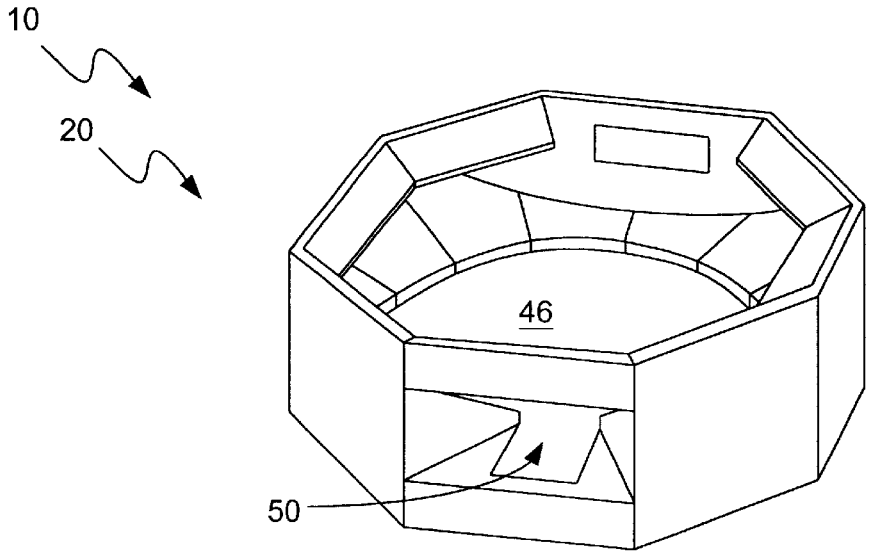
FIG. 5 is a perspective view of an alternative embodiment of the present invention.

As shown in FIGS. 4 and 5, alternative embodiments of the game 10 are provided which do not require a carrying case 12. In each of these embodiments, base 20 preferably is formed as a particularly robust component which is suitable for transportation without encasing the base within a case. Additionally, the embodiment of FIG. 5 is depicted with a dice chute or gap 50 which is bounded on its sides by stadium features. Although not shown, other embodiments also can be provided which do not incorporate a gap (e.g., embodiments which do not provide entry to playing surface 46 through a wall). In these gap-less embodiments, game play preferably is accomplished by rolling the dice onto the playing surface, i.e., rolling the dice into the "stadium" from above the playing surface.

Figure 6:
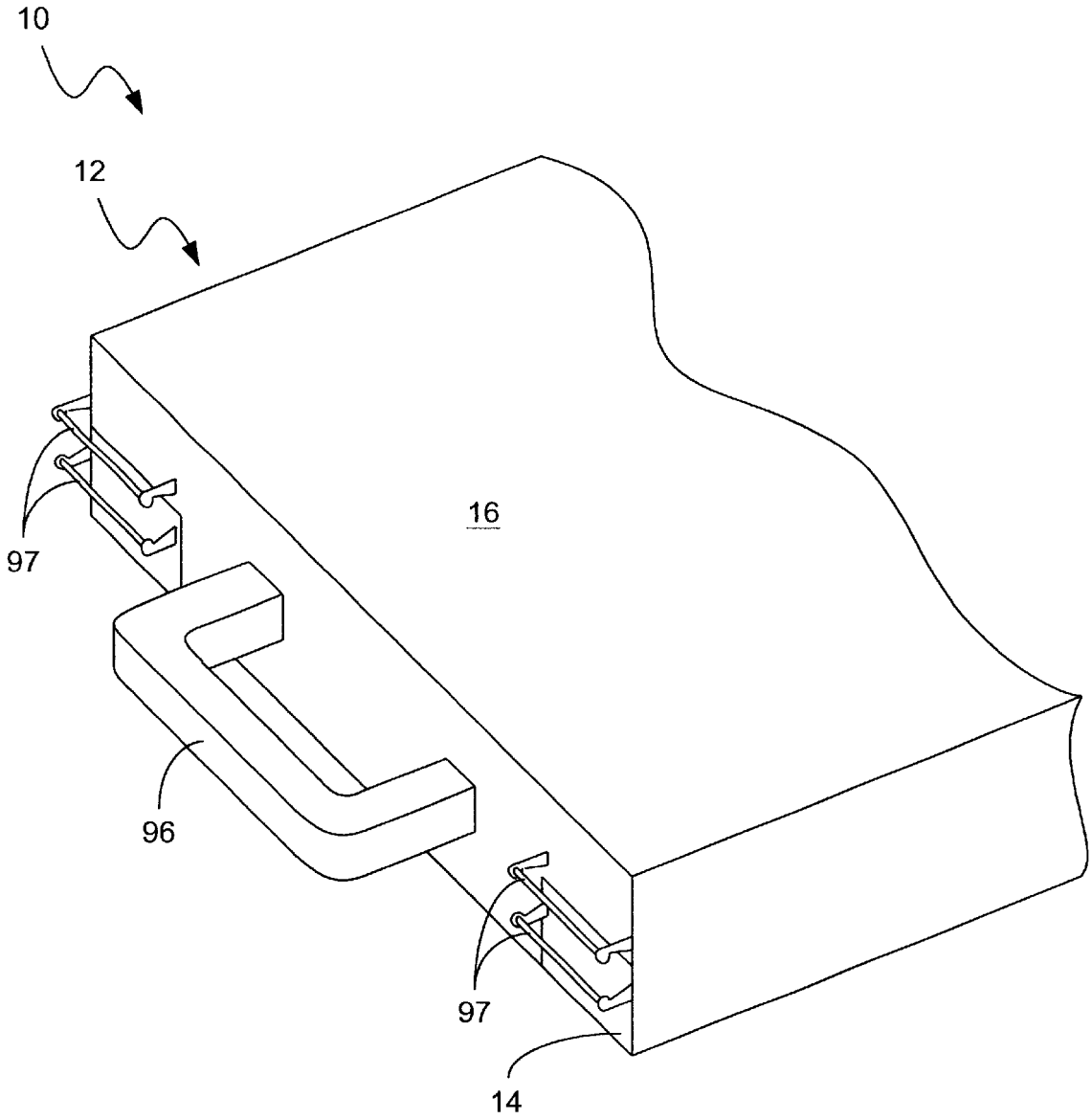
FIG. 6 is a perspective view of a preferred embodiment of the present invention with the lid in a closed position, showing detail of a latching mechanism.

In the embodiment of FIG. 6, which depicts case 12 in its closed positions handle 96 is provided in a single-piece configuration. Opposing latch members 97 are provided adjacent the handle, with one of the members 97 being attached to the base 14 and its opposing member being attached to the lid 16. A conventional latch (not shown) may be provided for securing the latch members together.

Preferred methods for playing game 10 are provided hereinafter as preferred rules of game play, although the present invention may be practiced with various other rules. In particular, multiple sets of preferred rules are provided so that multiple versions of the game, each with a varying level of skill, can be played.

Rules

Is The Basic Rules disclosed hereinafter apply to three preferred versions of game play, i.e., General Game, Intermediate Game and Strategy Game, although various other rules may be adapted for use with the present invention. As disclosed hereinafter, additional Rules for the Intermediate and Strategy Game supercede Basic Rules when applicable.

Standards

A. The game is played with a player for the Visiting team and a player for the Home team.

B. Follow Basic Rules and Roll combinations for the General Game. Use the Additional Plays, as shown, for the Intermediate Game and the Strategy Game.

C. A Manager, or Player/Manager can direct Additional Plays and, with the use of a Scoring Sheet, handle lineups and substitutes.

D. A non-player may serve as a Rule Umpire.

Preferred Equipment

1. One Baseball Game structure (described hereinbefore).
2. Two sets of baseball shaped dice, two per set, numbered from one to six (1–6).
3. Two sets of hats, three hats per set, numbered one, two, three (1,2,3).
4. Two sets of bats, four bats in each set. These represent the batter and runners.
5. One set of "Outs Markers," numbered one and two and three, (1-2-3).
6. Ten Scoring Sheets.

OBJECT of the GAME—Score more runs than your opponent in a regulation nine (9) inning game or in extra innings when the score is tied after the regulation game. Regulation game is eight and one half innings (8½) if the home team is ahead at that point.

SCOREBOARD

| | 1 | 2 | 3 | 4 | 5 | 6 | 7 | 8 | 9 | extra innings |
|---|---|---|---|---|---|---|---|---|---|---|
| Visiting Team | | | | | | | | | | |
| Home Team | | | | | | | | | | |

ORDER of PLAY—Visiting team bats (rolls dice) in the first half of each inning. Home team bats (rolls dice) in the second half of each inning. Each team is allowed three outs per inning. Both dice are rolled for each batter except: a single die is used for certain Additional plays in the Intermediate and Strategy Games.

OFFENSE—Play by 'Fair Rolling' the dice or die and advancing the Batter and/or base runners in accordance with the roll combination and rule. Combinations can be read either way, i.e., a roll of the dice with one die displaying a '5' and one die displaying a '2' is read as (5-2) or (2-5). It doesn't matter how it's interpreted because the result will be the game for that particular play. Combinations printed in Additional Rules will lead with the highest number first, i.e., Roll of (5-2) means 5-2 or 2-5. Note: (1) on all Fly Outs, the batter is out—runners, if any, do not advance; (2) on Ground Outs, with first base open, the batter is out—runners on other bases do not advance; (3) on Ground Outs, when runners are forced to advance, the lead-forced runner is out, the batter is safe at first base and runners who were not forced to run do not advance.

DEFENSE—For each batter the, defense will place on the playing surface a "Hat" with the number 1 or 2 or 3 on it which determines the 'Fair Roll' that will "count" for the batter. The 'Hat' can remain or be changed for subsequent batters. Once a selection is made it may not be changed during the batter's at-bat. For example, Defense places the #2 Hat on the field. This means the Offense must conduct two 'Fair Rolls' and the roll that determines the batter's outcome is the second 'Fair Roll' during that at-bat. So, in this case, if the Offense rolls the dice (Fair) once and a Home-Run is rolled, it doesn't count because it wasn't the second 'Fair' roll for the current at-bat.

Definitions

At Bat: 'Fair Rolling' the dice or die (according to the number of times the defense dictates by the 'Hats') for each batter.

Count Roll: Identifies which 'Fair Roll' is to be used to determine the outcome of a batter's at-bat. The Defense initiates this by placing a numbered 'Hat' on the playing surface for each batter. Designated Playing Surface: Flat surface within the stadium confines. Play is OK anywhere on the playing surface as long as one die completely clears the warning track.

Double Play: Two offensive players are 'OUTS' as the result of a single Count Roll.

Fair Roll: A correct roll of the dice or die is a 'Fair Roll'. To be a 'Fair Roll' at least one of the dice rolled must hit the backwall (fence) of the stadium and both dice or die (if only one die used) must come to a stop on the designated playing surface within the stadium structure. Preferably, at least one die must completely clear the warning Track margin. (Warning Track is the colored strip on the playing surface next to and curving with the fence around the field.)

Note: (1) A 'Hit or Walk' roll or a roll of the dice or die that allows a runner(s) to advance a base(s) that is not a 'Fair Roll' is called a 'Strike'. The roll does not count and the dice must be rolled again by the batter. Three 'Strike' rolls by a batter anytime during the at-bat, regardless of the defensive strategy, is an "Out", termed a strikeout; (2) Any and all "Out" roll combinations are counted as an 'Out' as long as the dice stop on the designated playing surface. In other words, if the roll that counts (as determined by the defense) wasn't a 'Fair Roll' and it is an out combination, then it's an 'Out' anyway. If it were a 'Hit', 'Walk' or a combination that allows the advancement of a runner, then it is a 'strike' and must be rolled again.

Hit(s): The batter advances to first base on a SINGLE, to second base on a DOUBLE, to third base on a TRIPLE, and all bases (scores a run) on a HOME RUN. Base runners advance in accordance with the roll combination. (Exception: See Extra Base Advancement and Hit-and-Run rules). Should the batter WALK, then runner(s) advance one base only if forced, i.e., runner on 2nd base and the batter 'Walks.' Batter is awarded 1st base but because the runner on 2nd base is not forced to move, runner remains on 2nd base. If the runner was on 1st base then the runner is forced to move to 2nd base.

Out: The batter has an at-bat and does not successfully reach base. A runner tries to advance one base or more and is unsuccessful in accordance with the rules that apply.

Runner: An offensive player who reaches base.

Scoring: Score one run for each player on Offense that starts at Home Plate as a Batter and reaches 1st base, 2nd base, 3rd base and Home Plate in that order before three outs are recorded for it's respective half inning.

Strike: A roll of the dice or die that is not a 'Fair Roll'.

Vocal Play: Offensive player must call this play 'OUT-LOUD' (so it is clearly understood the intentions of the play) before the Count Roll. This means it could be called anytime before the Count Roll, i.e., just before the third roll with the #3 Hat on the playing surface.

Walk: An award of first base to the batter. If forced, a runner(s) on base advances one base.

General Game

Dice Combinations

A Fly Out to left field is interpreted as a fly ball to the left fielder and caught for an out. A shallow Fly Out could involve an infielder. A Ground Out to third base is interpreted as a ground ball hit to the third baseman generating an out, etc.

(6-6) -Home Run
(6-5) -Fly Out to center field
(6-4) -strike Out
(6-3) -Ground Out to third base
(6-2) -Fly Out to center field
(6-1) -Single
(5-6) -Fly Out to center field
(5-5) -strike Out
(5-4) -Fly Out to left field
(5-3) -Fly Out to left field
(5-2) -SINGLE
(5-1) -Ground Out to third base
(4-6) -strike Out
(4-5) -Fly Out to left field
(4-4) -Fly Out to right field
(4-3) -SINGLE
(4-2) -Ground Out to shortstop
(4-1) -Ground Out to shortstop
(3-6) -Ground Out to third base
(3-5) -Fly Out to left field
(3-4) -SINGLE
(3-3) -TRIPLE
(3-2) -Ground Out to second base
(3-1) -Ground Out to first base
(2-6) -Fly Out to center field
(2-5) -SINGLE
(2-4) -Ground Out to shortstop
(2-3) -Ground Out to second base
(2-2) -DOUBLE
(2-1) -WALK
(1-6) -SINGLE
(1-5) -Ground Out to third base
(1-4) -Ground Out to shortstop
(1-3) -Ground Out to first base
(1-2) -WALK
(1-1) -Strike Out Additional Plays General Game: None

EXAMPLES

General Game:

1. Runner on first base from a single. Offense rolls a Fly Out to center field Batter is out and runner remains on first base.
2. Bases are loaded (runner on every base), and Offense rolls a Fly Out to left field. Batter is out and all runners remain at their respective base. No runs are scored.
3. Runner on first base from a walk, Offense rolls a Ground Out to third base. Since the runner on first is the lead runner and is forced to move toward second base, the runner is out going to second base but batter is safe at first base.
4. Runner on second and third base. Offense rolls a Ground Out to second base. Since first base is open, batter is out at first base and all other runners remain at their respective bases (do not advance).
5. Runners on first and third base. Offense rolls a Ground Out to first base. Since runner on first is forces to advance and is the lead forced runner, that runner is out at second and batter is safe at first base. Runner on third base remains at third base (does not advance).

In all these examples, the situation remains the same after the 'Out' roll. If there were runners on first and third before the 'Out' roll, then there will be runners on first and third after the 'Out.'

Intermediate Game

Dice Combinations and Rules

Follow Basic Rules unless an Additional Rule is applicable. Additional Rules override the Basic Rules. A Fly Out to left field is interpreted as a fly ban to the left fielder and caught for an out. A shallow Fly Out could involve an infielder. A Ground Out to third base is interpreted as a around ball hit to the third baseman generating an out, etc. A DOUBLE PLAY could be a ground out or a fly out.

(6-6) -Home Run
(6-5) -Fly Out to center field- See Sacrifice Fly
(6-4) -strike Out
(6-3) -Ground Out to third base
(6-2) -Fly Out to center field
(6-1) -Single
(5-6) -Fly Out to center field- See Sacrifice Fly
(5-5) -strike Out
(5-4) -Fly Out to left field- See Sacrifice Fly
(5-3) -Fly Out to left field
(5-2) -SINGLE
(5-1) -Ground Out to third base
(4-6) -strike Out
(4-5) -Fly Out to left field- See Sacrifice Fly
(4-4) -Fly Out to right field- See Sacrifice Fly
(4-3) -SINGLE- See Extra Base Advancement
(4-2) -Ground Out to shortstop
(4-1) -Ground Out to shortstop- See Double Play
(3-6) -Ground Out to third base
(3-5) -Fly Out to left field
(3-4) -SINGLE- See Extra Base Advancement
(3-3) -TRIPLE
(3-2) -Ground Out to second base- See Double Play
(3-1) -Ground Out to first base
(2-6) -Fly Out to center field
(2-5) -SINGLE
(2-4) -Ground Out to shortstop
(2-3) -Ground Out to second base- See Double Play
(2-2) -DOUBLE
(2-1) -WALK
(1-6) -SINGLE
(1-5) -Ground Out to third base
(1-4) -Ground Out to shortstop- See Double Play
(1-3) -Ground Out to first base
(1-2) -WALK
(1-1) -Strike Out Additional Plays Intermediate Game DOUBLE PLAY: If there are no runners on base then result is an ordinary ground out with only one out credited. WITH RUNNE(S) ON BASE AND LESS THAN TWO (2) OUTS: Roll of (4-1) or (3-2)—DOUBLE PLAY. Lead runner and Batter are 'Outs' with no advancement of any Base Runner.

Extra Base Advancement

Roll of (4-3)—Batter singles and is safe at first base. All other runners advance two (2) bases. SACRIFICE BUNT {VOCAL PLAY)—A SINGLE DIE IS USED. Play can be used when there is None or One out and pertains to a runner on first base only with second base open. A runner on third base is unaffected by this play and will remain on third base regardless of the outcome. A runner on third base can not score on this play. (See Squeeze Play—Strategy Game for that situation.) Before the roll that "counts" for the play is made, the Offensive player must say "Sacrifice Bunt"

ALOUD. WITH RUNNER ON FIRST BASE AND SECOND BASE OPEN AND LESS THAN TWO OUTS:

Roll of (1-_) Runner is OUT trying to advance to second base. Batter is safe at first base.

Roll of (2-_) or (3-_) or (4-_) Runner advances to second base. Batter is OUT.

Roll Of (5-_) DOUBLE PLAY. Runner advancing to second base and Batter are OUTS.

Roll of (6-_) Everyone is safe. Runner advances to second base. Batter is safe at first with a BUNT SINGLE.

SACRIFICE FLY—If there are no runners on base or only on first base this rule does not apply. WITH A RUNNER ON THIRD BASE AND LESS THAN TWO (2) OUTS:

Roll of (6-5) or (5-4) or (4-4)—Batter is OUT. Runner on third base run advances one base thus scoring a run. No other runners advance. WITH A RUNNER ON SECOND BASE OR THIRD BASE OR BOTH AND LESS THAN TWO (2) OUTS:

Roll of (4—4)—Batter is OUT. Runner(s) on second, third or both advance one base. A runner on first base does not advance.

Strategy Game

Dice Combinations and Rules

Follow Basic Rules unless an Additional Rule is applicable. Additional Rules override Basic Rules. A Fly Out to left field is interpreted as a fly ban to the left fielder and caught for an out. A shallow Fly Out could involve an infielder. A Ground Out to third base is interpreted as a ground ball hit to the third baseman generating an out, etc. A DOUBLE PLAY could be a ground out or a fly out.

Please review Additional Plays. Not all Additional Plays are associated with Roll Combinations listed below.

(6-6) -Home Run
(6-5) -Fly Out to center field- See Sacrifice Fly
(6-4) -strike Out
(6-3) -Ground Out to third base
(6-2) -Fly Out to center field
(6-1) -Single- See Extra Base Advancement
(5-6) -Fly Out to center field- See Sacrifice Fly
(5-5) -Strike Out
(5-4) -Fly Out to left field- See Sacrifice Fly
(5-3) -Fly Out to left field
(5-2) -SINGLE
(5-1) -Ground Out to third base
(4-6) -Strike Out
(4-5) -Fly Out to left field- See Sacrifice Fly
(4-4) -Fly Out to right field- See Sacrifice Fly
(4-3) -SINGLE- See Extra Base Advancement
(4-2) -Ground Out to shortstop- See Fielder's Choice
(4-1) -Ground Out to shortstop- See Double Play
(3-6) -Ground Out to third base
(3-5) -Fly Out to left field
(3-4) -SINGLE- See Extra Base Advancement
(3-3) -TRIPLE
(3-2) -Ground Out to second base- See Double Play
(3-1) -Ground Out to first base- See Fielder's Choice
(2-6) -Fly Out to center field
(2-5) -SINGLE
(2-4) -Ground Out to shortstop- See Fielder's Choice
(2-3) -Ground Out to second base- See Double Play
(2-2) -DOUBLE
(2-1) -WALK
(1-6) -SINGLE- See Extra Base Advancement
(1-5) -Ground Out to third base
(1-4) -Ground Out to shortstop- See Double Play
(1-3) -Ground Out to first base- See Fielder's Choice
(1-2) -WALK
(1-1) -Strike Out Additional Plays Strategy Game DOUBLE PLAY—With runner(s) on base and less than two (2) outs: If there are no runners on base then result is an ordinary ground out with only one out credited. WITH RUNNERS ON BASE AND LESS THAN TWO (2) OUTS:

Roll of (4-1)—DOUBLE PLAY, Lead Runner and Batter are 'Outs' with no advancement of any base runner.

Roll of (3-2)—DOUBLE PLAY, Lead Forced Runner and Batter are Outs. All other runners advance one base. If no runner is forced to advance then Lead Runner and Batter are OUTS. All other runners advance one base.

Extra Base Advancement

WITH LESS THAN TWO OUTS: Roll of (4-3)—Batter is safe at first base. All other runners advance two (2) bases.

WITH TWO OUTS: Roll of (4-3) or (6-1)—Batter is safe at first base. All other runners advance two (2) bases.

FIELDER'S CHOICE—Allows base runners to advance on a Ground Out. Only the rolls listed for the situations depicted below are considered, otherwise follow Basic Rules for the roll.

RUNNER ON SECOND AND FIRST with THIRD BASE OPEN: Roll of(3-1)—Runner advances to third base. Batter is out at first base.

RUNNER ON SECOND OR THIRD OR BOTH with FIRST BASE OPEN: Roll of (4-2)—Runners advance one base. Batter is out at first base.

HIT-AND-RUN (VOCAL PLAY)—With at least one runner on base and NONE or ONE out and before the "Count Roll" is made, the Offensive player must say "Hit-and-Run" aloud. Outcome of this play occurs on the "Count Roll." WITH AT LEAST ONE RUNNER ON BASE AND NONE OR ONE OUT:

On any 'HIT' combination roll, except (4-3), the Batter takes base as rolled. All other Runners advance with the roll plus one base.

On a (4-3) roll—Batter is safe at first with a Single. All other runners score.

On a Ground Out roll—Batter is out, all other runners advance one base.

On a (5-3) or (6-2) Fly Out roll—DOUBLE PLAY—Lead Runner and Batter are OUTS. Other Runners do not advance.

On a (6-5) or (5-4) or (4—4) Fly Out roll—Batter is out. Runners do not advance.

On a (1—1) or (5—5) or (6-4) Strike Out roll—DOUBLE PLAY—Lead runner and Batter are OUTS. All other runners advance one base.

On a (2-1) 'Walk' roll—Batter takes first base. Runners advance only if forced. SACRIFICE BUNT—(VOCAL PLAY)—A SINGLE DIE IS USED. Play can be used when there is NONE or ONE out and pertains to a runner on first base, second base or both. A runner on third base is unaffected by this play and will remain on third base regardless of the outcome. A runner on third base can not score on this play. (See Squeeze Play for that situation.) Before the roll that "counts" for the play is made, the Offensive player must say "Sacrifice Bunt" ALOUD. See below for specific situations. WITH RUNNER ON FIRST BASE AND SECOND BASE UNOCCUPIED:

Roll of 1—Runner is OUT trying to advance to second base. Batter is safe at first base.

Roll of 2 or 3 or 4—Runner advances to second base. Batter is OUT.

Roll Of 5—DOUBLE PLAY. Runner and Batter are OUTS.

Roll of 6—Everyone is safe. Runner advances one base. Batter is safe at first. WITH RUNNER ON SECOND BASE AND FIRST AND THIRD BASE UNOCCUPIED:

Roll of 1 or 3—Runner is OUT trying to advance to third base. Batter is safe at first base.

Roll of 2 or 4—Runner advances to third base. Batter is OUT.

Roll Of 5—DOUBLE PLAY. Runner and Batter are OUTS.

Roll of 6—Everyone is safe. Runner advances one base. Batter is safe at first. WITH RUNNER ON FIRST AND SECOND BASE AND THIRD BASE UNOCCUPIED:

Roll of 1 or 3—Runner advancing to third is OUT. Runner advancing to second is safe. Batter is safe at first.

Roll of 2—Runners advance one base. Batter is OUT.

Roll of 4—Runner advancing to third is safe. Runner advancing to second is OUT. Batter is safe at first.

Roll of 5—DOUBLE PLAY. Runner advancing to third is safe. Runner advancing to second and Batter are OUTS.

Roll of 6—Everyone is safe. Runners advance one base. Batter is safe at first. SACRIACE FLY—If there are no runners on base or only on first base this rule does not apply.

WITH A RUNNER ON THIRD BASE AND LESS THAN TWO OUTS:

Roll of (6-5) or (5-4) or (4—4)—Batter is OUT. Runner on third base run advances one base thus scoring a run. No other runners advance.

Roll of (4—4)—Batter is OUT. Runner(s) on second or third or both advance one base. A runner on first base does not advance.

STEALING—(VOCAL PLAY)—Only stealing of second base is allowed. Defense does not determine a "Count Roll" for stealing. Once the Offense decides to Steal the very next roll of the dice is the "Count Roll" for the steal only. When the steal attempt is finished, the Batter resumes the at-bat as determined by the Defense's "Count Roll" unless Batter Walks or was involved in a DOUBLE PLAY. With one exception, a Runner on third base is not involved in this play and shall remain on third after the play. Before the "Count Roll" for the play is made, the Offensive player must say "Stealing" ALOUD. (See examples.)

STEALING SECOND BASE—(RUNNER ON FIRST BASE with SECOND BASE UNOCCUPIED):

Roll of(6-3), (5-1}, (4-2), (3-2), (3-1) or any "Hit" combination—Runner successfully steals second base. Batter resumes at-bat.

Roll of (2-1)—Batter is awarded first base on a Walk and Runner advances to second. New Batter.

Any other Roll—Runner is OUT attempting to steal second base—Batter resumes at-bat.

On a Strike Out roll (1-1), (5-5) or (6-4) with None or One Out—DOUBLE PLAY—Runner and Batter are OUTS. New Batter if inning continues.

Roll of (6-6) with a runner on third base—Runner on third Scores. Runner stealing is safe at second base.

SQUEEZE BUNT (VOCAL PLAY)—A SINGLE DIE IS USED. Offense must have a runner on third with NONE or ONE out. Before the "count roll" is made, the Offensive player must say "Squeeze Bunt" ALOUD. WITH A RUNNER ON THIRD BASE AND NONE OR ONE OUT:

Roll of 1-2-3-4—Runner on third is OUT at home. Batter is safe at first. Other runners advance one base.

Roll of 5—DOUBLE PLAY—Runner on third and Batter are OUTS. No other runners advance.

Roll of 6—Everyone is safe. Runner on third scores. Batter is safe at first. Other runners advance one base.

EXAMPLES (Strategy Game)

Doubleplay

Runner on first and second base, none out. Roll of (4-1)—Lead runner on second and batter are OUTS. Runner on first remains on first. Now there are two outs.

Runner on first and third base, none out. Roll of (4-1)—Lead runner on third and batter are OUTS. Runner on first remains on first Two outs.

Same situation, but this time the roll is (3-2)—Here the lead forced runner is on first base. That runner must run to second on a ground ball, the runner on third base is not forced to run. The lead-forced runner and batter are outs but the runner on third advances one base and scores a run. If there was already one OUT then the inning is over and no runs score.

STEALING—(VOCAL PLAY)—A SINGLE DIE IS USED. Before the roll that "counts" for the play is made, the Offensive player must say "Stealing (whichever base)" ALOUD. Only the runner specified is effected by the roll of the die. All other runners remain at their respective bases and do not advance. Offense may steal more than one runner during an at-bat and may steal multiple bases. Each situation is a separate event. Find the situation that applies below. Only the situations presented below are allowed. With runners on second and third base, Offense does not have to conduct a Double Steal. Offense may elect to steal third only in that situation and then later in the inning may elect to steal second. When the stealing attempt(s) are complete, the Batter resumes the at-bat where it was paused unless Batter was involved in a DOUBLE PLAY.

STEALING SECOND BASE—(RUNNER ON FIRST BASE AND SECOND BASE UNOCCUPIED):

Roll of 1 or 3—Runner is OUT attempting Steal of second base.

Roll of 2 or 4 or 6—Runner STEALS second base.

Roll of 5—DOUBLE PLAY—Runner and Batter are OUTS. Batter credited with a Strikeout.

STEALING THIRD BASE—(RUNNER ON SECOND BASE AND THIRD BASE UNOCCUPIED):

Roll of 1 or 3 or 4—Runner is OUT attempting steal of third base.

Roll of 2 or 6—Runner STEALS third base.

Roll of 5—DOUBLE PLAY—Runner and Batter are OUTS. Batter credited with a Strikeout.

DOUBLE STEAL—RUNNERS STEALING SECOND AND THIRD IN ONE PLAY (RUNNERS ON FIRST AND SECOND BASE WITH THIRD BASE UNOCCUPIED):

Roll of 1 or 3 or 4—Runner is OUT attempting steal of third base. Other Runner Steals second base.

Roll of 2 or 6—Runner Steals third base. Runner attempting Steal of second base must roll the die and apply the rules for Stealing second base.

The foregoing description has been presented for purposes of illustration and description. It is not intended to be exhaustive or to limit the invention to the precise forms disclosed. Obvious modifications or variations are possible in light of the above teachings. The embodiments discussed, however, were chosen and described to provide the best illustrations of the principles of the invention and theirs practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled. For instance, although the embodiments discussed incorporated dice for generating random number sequences, alternative embodiments can incorporate random number generators of various types. Additionally, automatic scoring systems are also envisioned and are within the scope of the invention.

What is claimed is:

1. A board game for simulating the play of baseball thereon comprising:

at least one die;

a carrying case having a base and a movable lid hingedly attached thereto, said lid being movable between a closed position and an open position, in said closed position, said lid engaging said base to define a cavity therebetween, said base having a wall extending upwardly from a periphery thereof, said wall having first and second ends spaced from each other and forming a gap therebetween, said gap being sized and shaped for passing said at least one die therethrough;

a playing surface having indicia of baseball bases formed thereon and a hole formed adjacent each of said indicia, said playing surface being arranged on said base and bounded at least partially thereabout by said wall such that said at least one die can engage said playing surface by entering said cavity via said gap, and;

a plurality of game pieces representative of baseball players, each of said game pieces being configured to removably engage within said hole of each of said indicia of baseball bases such that said at least one die engages said playing surface and at least one of said plurality of game pieces is disengaged from said hole of a first of said indicia of baseball bases and engages said hole of a second of said indicia of baseball bases in response to said at least one die thereby simulating the play of baseball.

2. The board game of claim 1, wherein at least a portion of said playing surface is formed of a flocked plastic material such that said flocked plastic material provides deadening of sound produced by said at least one die impacting said playing surface.

3. The board game of claim 1, wherein said base has a front edge, a rear edge opposing said front edge, and opposing side edges interconnecting said front and rear edges, and wherein said wall comprises a rear wall, first and second side walls, and first and second front wall segments, said rear wall extending upwardly from said rear edge, said first side wall extending upwardly from one of said edges, said second side wall extending upwardly from another of said side edges, said first and second front wall segments extending upwardly from said front edge and extending along said front edge toward each other to form said gap therebetween.

4. The board game of claim 1, further comprising a rear containing wall extending downwardly from said rear wall toward said playing surface, said rear containing wall being configured to deflect said at least one die therefrom and toward said playing surface.

5. The board game of claim 1, further comprising first and second area containing barriers, said first area containing barrier interconnecting said first side wall and said first front wall segment and forming a first compartment therebetween, said second area containing barrier interconnecting said second side wall and said second front wall segment and forming a second compartment therebetween, said first and second compartments being sized and shaped to receive said plurality of game pieces therein.

6. A board game for simulating the play of baseball thereon comprising:

at least one die;

a carrying case having a base and a movable lid hingedly attached thereto, said lid being movable between a closed position and an open position, in said closed position, said lid engaging said base to define a cavity therebetween, said base having a wall extending upwardly from a periphery thereof, said wall having first and second ends spaced from each other and forming a gap therebetween such that said gap is defined at least partially by said base, said first end of said wall and said second end of said wall, said gap being sized and shaped for passing said at least one die therethrough;

a playing surface arranged within said cavity, said playing surface having indicia of baseball bases formed thereon, said playing surface being bounded at least partially thereabout by said wall such that said at least one die can engage said playing surface by entering said cavity via said gap, said wall being adapted to reduce a tendency of said at least one die to come to rest outside said playing surface when said at least one die is rolled onto said playing surface via said gap, at least a portion of said wall being adapted to deflect said at least one die toward said playing surface;

indicia of stadium seating arranged at least partially about a periphery of said playing surface, said indicia of stadium seating extending upwardly from said playing surface and being arranged at least partially between said playing surface and said wall; and a plurality of game pieces, each of said game pieces being configured to be moved relative to each of said indicia of baseball bases such that the play of baseball can be simulated by moving at least one of said game pieces in response to said at least one die.

7. The board game of claim 6, wherein at least a portion of said playing surface is formed of a material that provides deadening of sound produced by said at least one die impacting said playing surface.

8. The board game of claim 7, wherein said material is a flocked plastic material.

9. The board game of claim 6, wherein said wall includes a first portion, said first portion being inclined downwardly toward said playing surface, said first portion being configured to deflect said at least one die toward said playing surface.

10. The board game of claim 6, further comprising:

a first containing barrier and a second containing barrier, said first containing barrier extending upwardly from said base, said first containing barrier engaging said wall and forming a first compartment therebetween, said second containing barrier extending upwardly from said base, said second containing barrier engaging said wall and forming a second compartment therebetween, said first compartment and said second compartment being sized and shaped to receive said plurality of game pieces therein.

11. The board game of claim 6, further comprising:

a wall segment arranged adjacent to said gap, said gap being defined at least partially by said base, said first end of said wall, said second end of said wall and said wall segment such that said gap is bounded about a periphery thereof.

* * * * *